US007018475B2

(12) United States Patent
Ueberschär et al.

(10) Patent No.: US 7,018,475 B2
(45) Date of Patent: Mar. 28, 2006

(54) DEVICE, METHOD AND ARRANGEMENT FOR PRESSING TWO AXIS-PARALLEL ROLLERS APPROACHABLE TO ONE ANOTHER IN A DEVICE FOR PRODUCING AND/OR TREATING A WEB OF MATERIAL

(75) Inventors: Manfred Ueberschär, Gerstetten (DE); Christoph Henninger, Heidenheim (DE); Eckard Wozny, Heidenheim (DE); Horst Kaipf, Lauingen (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/719,201

(22) Filed: Nov. 21, 2003

(65) Prior Publication Data

US 2004/0185171 A1 Sep. 23, 2004

Related U.S. Application Data

(63) Continuation of application No. PCT/EP02/05622, filed on May 22, 2002.

(30) Foreign Application Priority Data

May 23, 2001 (DE) ..... 101 25 378
May 23, 2001 (DE) ..... 101 25 379

(51) Int. Cl.
*B05C 1/08* (2006.01)

(52) U.S. Cl. ..... 118/663; 118/708; 118/712; 118/227; 118/249; 118/255; 118/262

(58) Field of Classification Search ..... 118/663, 118/708, 712, 227, 249, 259, 262, 225, 226, 118/255; 427/8, 428, 208–208.8, 209, 211, 427/428.11, 428.17; 101/247; 162/358.1; 100/50

See application file for complete search history.

(56) References Cited

U.S. PATENT DOCUMENTS

| | | | | |
|---|---|---|---|---|
| 2,691,326 | A | 10/1954 | McArn | 92/49 |
| 2,729,003 | A | 1/1956 | Cohn et al. | 38/52 |
| 4,191,341 | A | 3/1980 | Looser | 242/56 |
| 5,462,594 | A | 10/1995 | Rantanen | 118/249 |
| 5,562,027 | A | 10/1996 | Moore | 100/35 |
| 5,611,500 | A | 3/1997 | Smith | 242/541.4 |
| 5,803,969 | A * | 9/1998 | Knop | 118/227 |
| 6,409,857 | B1 * | 6/2002 | Pallas et al. | 156/64 |

FOREIGN PATENT DOCUMENTS

| | | |
|---|---|---|
| DE | D3627463 | 2/1988 |
| EP | 0242783 | 10/1987 |
| EP | 0502237 | 5/1991 |
| EP | 0978589 | 8/1999 |

* cited by examiner

*Primary Examiner*—Laura Edwards
(74) *Attorney, Agent, or Firm*—Taylor & Aust, P.C.

(57) ABSTRACT

Two axially parallel rolls are pressed against each other in a device for producing and/or treating a moving material web. Sensor elements are arranged in the force transmission path running from the force-producing elements via the rolls, outside roll bodies of the two rolls. As a result of displacing the sensor elements out of the roll bodies of the rolls, the production of the rolls is less complicated and less expensive. No sensors have to be embedded in the roll bodies, which opens up the possibility of using standard rolls. In addition, the occasional grinding of the rolls can in this way be performed without any regard to the sensor elements. Nevertheless, the pressure prevailing between the rolls can continue to be measured directly, since the sensor elements are arranged in the transmission path of the pressing force.

23 Claims, 2 Drawing Sheets

DEVICE, METHOD AND ARRANGEMENT FOR PRESSING TWO AXIS-PARALLEL ROLLERS APPROACHABLE TO ONE ANOTHER IN A DEVICE FOR PRODUCING AND/OR TREATING A WEB OF MATERIAL

CROSS REFERENCE TO RELATED APPLICATIONS

This is a continuation of PCT application No. PCT/EP02/05622, entitled "DEVICE, METHOD AND ARRANGEMENT FOR PRESSING TWO AXIS-PARALLEL ROLLERS APPROACHABLE TO ONE ANOTHER IN A DEVICE FOR PRODUCING AND/OR TREATING A WEB OF MATERIAL", filed May 22, 2002.

BACKGROUND OF THE INVENTION

1. Field of the invention

The present invention relates to producing and/or treating a moving, material web, and, more particularly to pressing two axially parallel rolls against each other in a device for producing and/or treating a moving material web.

2. Description of the Related Art

Pairs of rolls are often used in machines on which paper, board or other material webs are produced or treated. By way of such pairs of rolls, material webs are, for example, calendered, coated or printed. Here, great attention is regularly paid to the pressing force transmitted between the rolls of the pair. Maintaining a specific pressing force is usually of critical importance for the result of the treatment of the material web, be it, for example, the calendering result in the calender or the coating result when applying a size or a pigment-containing coating color.

EP 0 978 589 A2 discloses registering the pressing force transmitted between a pair of rolls and, in particular, its axial distribution, by way of sensors which are embedded into one of the rolls close to the surface, specifically in the shell of the roll or in a cover fitted to the shell. Although the line pressure between the rolls can be registered very accurately in this way and, in the event of deviations from the desired values, appropriate activation of suitable force devices can be carried out in order to effect more intense or less intense pressing of the rolls, embedding the sensors in the roll body admittedly has the disadvantage that this makes the production of the roll more difficult and more expensive. In addition, it is necessary to take into account that, from time to time, grinding of the outer functional layer of the roll can be necessary in order to rectify damage in the roll surface. If the sensors are arranged close to this functional layer or even embedded in the latter, this can result in the outer layer of the roll being available for the grinding only over a small part of its thickness and replacement of the roll can be required correspondingly early.

SUMMARY OF THE INVENTION

According to a first aspect of the present invention, the sensor elements are arranged in the force transmission path running from the force-producing elements via the rolls, outside roll bodies of the two rolls. As a result of displacing the sensor elements out of the roll bodies of the rolls, the production of the rolls is less complicated and less expensive. Since no sensors have to be embedded in the roll bodies, this opens up the possibility of using standard rolls. In addition, the occasional grinding of the rolls can in this way be performed without any regard to the sensor elements.

Nevertheless, the pressure prevailing between the rolls can continue to be measured directly, since the sensor elements are arranged in the transmission path of the pressing force.

If, here, a roll body of a roll is mentioned, in the following text this is substantially understood to describe the generally hollow-cylindrical barrel-like structure, usually covered with a cover of resilient or hard material, which forms the actual roll. Bearing journals, which are used for the rotatable mounting of the roll, are in this case not included in the roll body.

It is in principle conceivable for the force provided by the force-producing elements to be transmitted substantially completely on the force transmission path running via the rolls, as the single force transmission path. However, provision can also be made for the force provided by the force transmitting elements to be branched to the force transmission path running via the rolls and at least one further force transmission path. In this case, the sensor elements are arranged in the force transmission path running via the rolls after it branches away from the further force transmission path.

In the event that a plurality of parallel force transmission paths are provided for the force provided by the force-producing elements, then there is an advantageous possibility of influencing the effective pressing force between the rolls, in that the ratio of the forces transmitted via the various force transmission paths can be varied. For this purpose, stop elements which can be adjusted in order to change the ratio of the forces transmitted via the various force transmission paths are arranged in the further force transmission path.

In principle, it is sufficient to measure the force transmitted only at one point along the force transmission path running via the rolls. This point can be located upstream of the roll body of a first following one of the two rolls or downstream of the roll body of a second following one of the two rolls. However, it is also possible to perform a force measurement simultaneously at a plurality of points along the force transmission path running via the rolls. For this purpose, the sensor elements can include at least one sensor which is arranged upstream of the roll body of the first following roll and at least one sensor arranged downstream of the roll body of the second following roll. It is advantageous in this case that the measured values supplied by the various sensors can be compared with one another, so that the sensors, so to speak, monitor one another. The reliability and accuracy of the force measurement can be increased in this way.

In a preferred embodiment of the present invention, one of the two rolls is mounted on a stand such that its position is fixed relative to the latter but it can rotate, a bearing lever which mounts the other roll such that it can rotate being fitted to the stand and being able to be pivoted relative to the stand in order to bring the two rolls close to each other. In this embodiment, the force-producing elements act on the bearing lever.

The sensor elements can then include at least one sensor which is fitted to the bearing lever or the stand. When configuring the bearing lever and stand and the position of the sensor, care must be taken that the sensor detects exactly that force component which is introduced into the pair of rolls.

Alternatively or additionally, the sensor elements can include at least one sensor which is arranged in a bearing region of one of the rolls. For example, the sensor can in this case be fitted to a bearing journal of the relevant roll. However, an antifriction bearing enclosing a bearing journal of the relevant roll can also be provided with the sensor. In the latter case, the sensor can be integrated into the antifriction bearing or fitted onto an outer ring of the antifriction bearing. It is also possible to imagine the sensor being fitted to a bearing housing in which an antifriction bearing surrounding a bearing journal of the relevant roll is accommodated.

Furthermore, additionally or alternatively to the possible sensor locations indicated above, the sensor elements can include at least one sensor which is accommodated in a separately produced sensor module, this sensor module being built in between the stand or the bearing lever and a bearing kit for a bearing journal of the roll held on the stand or the bearing lever. Such sensor modules are commercially available in the form of mechanically self-contained sealed force-measuring cells. For the mounting of the rolls, it is then possible to fall back on standard, standardized bearing kits, which has a cost-reducing effect.

The sensor elements for sensing force can include at least one tension and/or pressure-sensitive element, in particular a strain gage. Sensor elements of this type are known in many configurations and have proven to be rugged, reliable and precise in practical use. Of course, sensor elements based on other measuring principles can also be used, if they are capable of providing a sensor signal representative of the pressing force between the rolls.

An electronic control unit is expediently provided which responds to the sensor elements and controls the force-producing elements and which is set up for the regulated maintenance of a predefined desired value of the pressing force between the rolls. In this case, the force-producing elements in the region of both axial ends of the pair of rolls each include an independently controllable, in particular hydraulic, force device, and the sensor elements can be designed for the mutually independent registration of the pressing force in both axial end regions of the pair of rolls. The control unit can then be set up to control the force devices in such a way that the result is a substantially constant line pressure between the rolls over the axial extent of the pair of rolls, as is desired in numerous applications. At the same time, the possibility of programming the control unit in such a way that different values of the line pressure result in the two axial end regions of the pair of rolls is not ruled out.

The device according to the present invention is preferably intended for use in a coating unit, in which the material web is led through between the two rolls and at least one of the rolls is used to transfer the application medium to the material web.

According to a second aspect, in achieving the object specified above, the invention is based on a method of setting the pressure between two axially parallel rolls which can be moved toward each other in a device for producing and/or treating a moving material web, at least one of the rolls having a radially resilient roll cover.

According to the present invention, provision is made in this case for a distance-force characteristic for the pair of rolls to be determined, which represents a relationship between the mutual axial spacing of the two rolls and the pressing force transmitted between the two rolls, and, in order to achieve a desired pressing force of the rolls in working operation of the device, for an associated desired value of the axial spacing to be determined from the distance-force characteristic and set on the pair of rolls.

An embodiment of the present invention deviates from the previous procedure in that it does not register the pressing force transmitted between the rolls by way of pressure sensors and effects activation of the force devices which is based on the sensor signals. Instead, it makes use of the spring characteristics of the resilient covering of at least one of the rolls. It is based on the finding that, as a result of the flattening of the cover during pressing of the rolls, the mutual spacing between the axes of the two rolls changes as a function of the pressure prevailing between the two rolls. Accordingly, a "spring characteristic" for the pair of rolls can be determined, which places the pressing force transmitted between the rolls in a relationship with the mutual axial spacing of the rolls. If then, during working operation of the machine in which the pair of rolls is used, a specific pressing force is to be achieved, it is merely necessary to refer to the spring characteristic to see which associated axial spacing has to be set on the pair of rolls in order to obtain just this pressing force.

Embedding pressure sensors in one of the rolls is not necessary in the solution according to the present invention. Therefore, recourse can be had to current standard rolls, which are considerably less costly. In addition, the occasional grinding of the rolls can be carried out without difficulty and without there being the danger of damaging sensors embedded in the rolls as a result of this grinding.

If the distance-force characteristic provides different values of the axial spacing for different values of the pressing force, then the term axial spacing is here only representative of any design variable which is representative of the mutual axial spacing of the two rolls. For example, the distance-force characteristic can provide a position statement for an adjustable component that affects the axial spacing of the rolls instead of the axial spacing directly.

In principle, deriving the distance-force characteristic theoretically and representing it as a formula is not ruled out. As a rule, however, in order to determine the distance-force characteristic, it will be simpler to carry out measurements in a calibration phase of the device. These measurements can be carried out in particular with the rolls rotating, since it has been shown that the flexing processes which occur in the resilient cover during rotation can influence the spring characteristic of the pair of rolls. It is therefore recommended to determine the distance-force characteristic under conditions which come as close as possible to the conditions in working operation of the machine.

In order to determine the distance-force characteristic, at least two value pairs of axial spacing and pressing force will expediently be determined for different values of the pressing force. It is beneficial if, by measurement, a zero point and an end point of the spring characteristic of the pair of rolls are obtained. In order to determine the zero point, one of the value pairs can be determined for a close position of the rolls in which the rolls are moved toward each other substantially until mutual contact is produced but substantially no pressing force is transmitted between the rolls. The end point determination can be carried out by one of the value pairs being determined for a pressing force transmitted between the rolls which at least approximately corresponds to a maximum pressing force for which the device is designed.

It is in principle conceivable to record the spring characteristic substantially completely. However, it saves effort if only some points of the spring characteristic are determined and it is interpolated between these points. To a good approximation, it can often be assumed that the pair of rolls exhibits a linear spring behavior. The spring characteristic can then be determined in a very simple manner by linear interpolation.

As already explained at the beginning, occasionally remachining of the roll cover will be necessary in order to smooth the roll surface completely again and to free it of faults. To this end, the roll cover is ground until the roll surface is satisfactory again. Admittedly, the old spring characteristic will no longer apply to the ground roll cover. It is therefore recommended that the distance-force characteristic be determined again after the roll cover has been ground.

It is conceivable to set the desired value of the axial spacing determined from the spring characteristic once with the effect of open-loop control, for example by way of a distance-controlled actuating element, but not to continue to check its maintenance during working operation of the device. Then, however, static or dynamic distance fluctuations of the axes of the rolls, which can be brought about during working operation of the machine, for example as a result of thermal deformation, distortions or contact fluctuations, remain undetected. In order to be able to take such influences into account as well, regulation can be established in which, during working operation of the device, the actual axial spacing of the rolls is registered by sensors and adjusted to the desired value of the axial spacing.

It is frequently the case that the axial spacing of the two rolls in the region of the two axial ends of the pair of rolls can be set independently of one another. Although this opens up the possibility of setting a line pressure between the rolls which changes linearly in the axial direction, for most applications it will be desirable to set the axial spacings in the two axial end regions of the pair of rolls in such a way that the result is a substantially constant line pressure between the rolls over the axial extent of the pair of rolls.

In a preferred embodiment, the method according to the present invention is carried out in a machine for coating a paper or board web, the paper or board web being led through between the rolls and at least one of the rolls being used to transfer a liquid to pasty application medium to the paper or board web.

The present invention further relates to an arrangement for pressing against each other two axially parallel rolls in a device for producing and/or treating a moving material web, at least one of the rolls having a radially resilient roll cover, including actuating elements by way of which the two rolls can be moved toward each other along an approach path and can be set into a close state, in which a pressing force is transmitted between the rolls. This arrangement is intended in particular to be suitable for carrying out the method of the above type. According to the present invention, the arrangement includes a storage unit for storing a previously determined distance-force characteristic for the pair of rolls, which represents a relationship between the mutual axial spacing of the two rolls and the pressing force transmitted between the rolls, and a control unit which is connected to the storage unit and controls the actuating elements and which, in order to achieve a desired pressing force of the rolls, is designed to determine from the distance-force characteristic an associated desired value of the axial spacing and to effect the setting of this desired value on the pair of rolls. With regard to the advantages of the arrangement according to the present invention, reference is made to the above discussion of the method according to the present invention.

The arrangement can include sensor elements for registering the actual axial spacing of the rolls, the control unit responding to the sensor elements and being designed for the regulated maintenance of the desired value of the axial spacing.

The axial spacing of the rolls in the region of the two axial ends of the pair of rolls can be set independently of one another. The control unit is then preferably designed to set the axial spacings in the two axial end regions of the pair of rolls in such a way that the result is a substantially constant line pressure between the rolls over the axial extent of the pair of rolls.

One of the first rolls can be held on a roll carrier which can be displaced with respect to the second roll along the approach path. The actuating elements can then include force-producing elements acting on the roll carrier in order to introduce into the roll carrier a force that produces the pressing force.

The force made available by the force-producing elements can be used substantially completely for producing the pressing force. The force made available is in this case substantially transmitted on a single force transmission path which runs via the two rolls. Alternatively, the force made available by the force-producing elements can also be branched, specifically to a first force transmission path transmitting the pressing force between the two rolls and at least one second force transmission path. In this design, part of the force made available by the force-producing elements is transmitted on the first force transmission path via the pair of rolls, and another part of this force is transmitted on the at least one second force transmission path.

If the force made available by the force-producing elements is substantially completely transmitted on a single force transmission path running via the two rolls, a change in the axial spacing of the two rolls, and therefore a change in the pressing force acting between the two rolls, can be brought about by appropriate activation of the force-producing elements. If a plurality of parallel force transmission paths are provided, to which the force made available by the force-producing elements is distributed, one advantageous possibility of influencing the pressing force between the rolls includes the ratio between the force transmitted on the first force transmission path and the force transmitted on the at least one second force transmission path being variable. This can be implemented, for example, by stop elements which are arranged in the at least one second force transmission path and can be adjusted in order to change the ratio of the forces transmitted in the various force transmission paths. The position of the stop elements is then used as a variable which is representative of the mutual axial spacing of the rolls. For this purpose, it is merely necessary to determine which position of the stop elements corresponds to which value of the axial spacing of the rolls. Once this relationship is known, the stop elements merely have to be brought into the appropriate position in order to achieve a desired pressing force between the rolls.

The stop elements can include at least one stop which is arranged for common movement with the first roll along its approach path to the second roll, and at least one opposing stop fixed with respect to the axis of the second roll. In order to influence the force relationships between the various force transmission paths, at least one of the components: stop and opposing stop can then be adjustable.

The arrangement according to the present invention is preferably intended for use in a machine for coating a paper or board web. The paper or board web is preferably led through between the rolls, at least one of the rolls used to transfer a liquid to pasty application medium to the paper or board web.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
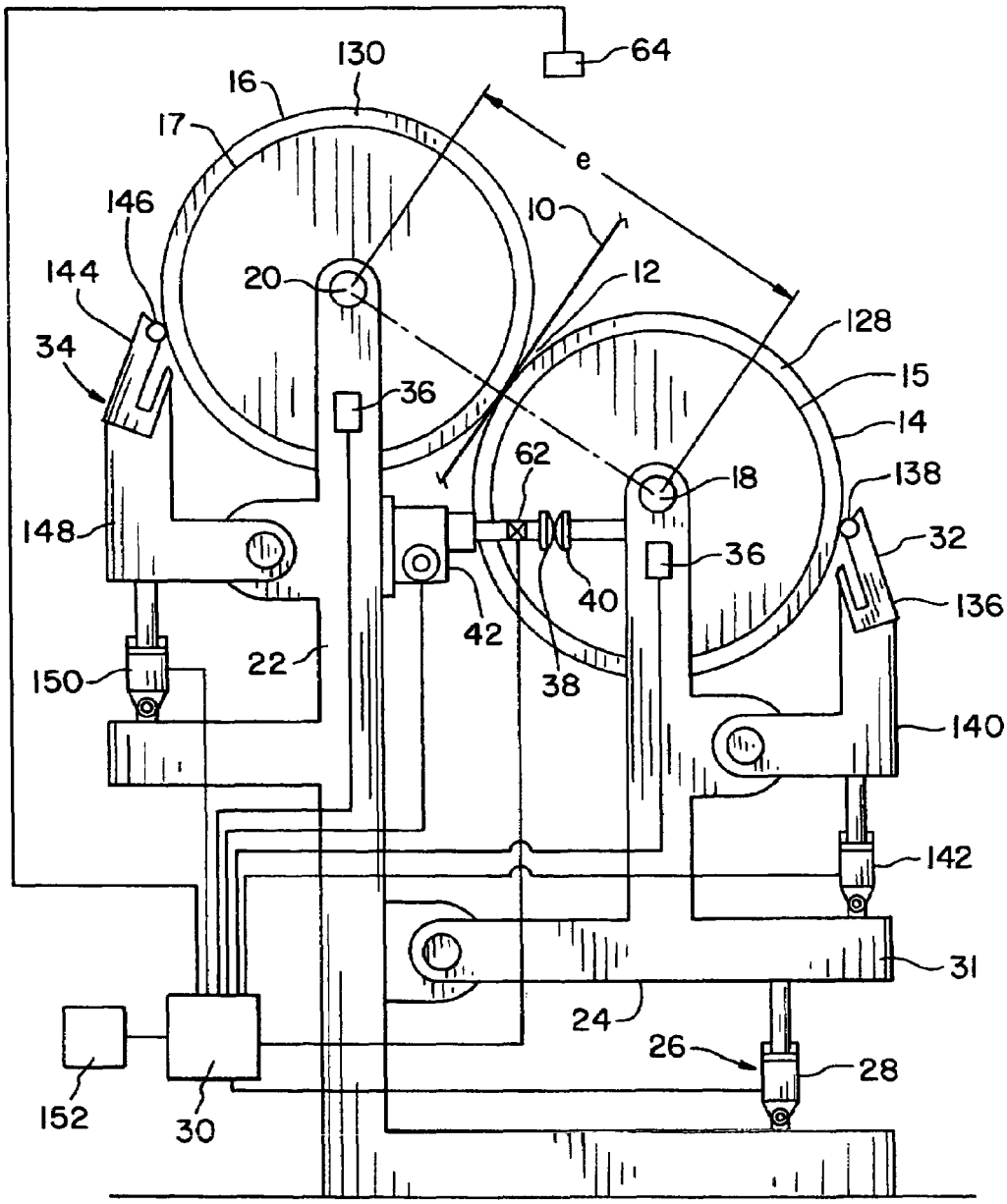
FIG. 1 is a schematic overall view of an embodiment of a coating unit with a sensor arrangement for the detection of the line pressure prevailing between a pair of rolls according to the present invention.

Referring now to the drawings, and more particularly to FIG. 1, there is shown a coating unit that is used for the indirect application of a liquid to pasty application medium, for example a pigment-containing coating color or a surface size, to both sides of a moving material web 10 of paper or board. Material web 10 moves through application gap 12, designated a nip in technical language, which is formed between two adjacently arranged rolls 14, 16 including roll bodies 15, 17, respectively. Roll bodies 15, 17 include the cylindrical portion of rolls 14, 16 and can also include covers 128, 130 on rolls 14, 16. Rolls 14, 16 are arranged with their axes 18, 20 parallel to each other. One of the rolls, roll 16, is used as a fixed roll, as it is known, while the other roll, roll 14, forms what is known as a moving roll. Roll 16 is arranged such that it can rotate about its axis 20 but is otherwise fixed in position, while moving roll 14 can be moved toward fixed roll 16 and away from the latter. For this purpose, fixed roll 16 is held on machine stand 22 anchored firmly to the floor. Bearing lever 24 fitted to machine stand 22 such that it can pivot carries moving roll 14. In order to pivot bearing lever 24 and therefore to bring moving roll 14 close to fixed roll 16 and press it on, a force device arrangement 26, which can be an actuating element, is used, which preferably has a hydraulic piston-cylinder unit 28 in the region of the two axial ends of the pair of rolls 14, 16. Force device arrangement 26 can be controlled by electronic control unit 30 of the coating unit, independent controllability of the individual force devices of force device arrangement 26 expediently being provided.

Each of rolls 14, 16 in the exemplary embodiment has resilient roll covers 128, 130 respectively, which include rubber or plastic material, for example. Within the context of the present invention, it is sufficient for only one of rolls 14, 16 to have a resilient cover. The other of the rolls can then, for example, bear a steel or chromium shell.

The coating medium with which material web 10 is to be coated is initially applied to rolls 14, 16 in a manner which is not specifically illustrated but known in the art. From there, the coating medium is then transferred to material web 10. Doctor mechanisms 32, 34 are used to meter and even out the coating medium applied to rolls 14, 16. Such doctor mechanisms are widely known in the prior art and do not require any specific explanation in connection with the present invention.

The amount and thickness of the medium applied to material web 10 is influenced by the nip load prevailing in application gap 12, that is the pressing force which is transmitted between rolls 14, 16. In order to know this nip load, the coating unit is equipped with a sensor arrangement which directly detects the pressing force transmitted. In this case, the sensor arrangement is arranged in the transmission path 31 of the pressing force and measures the latter before it is introduced into and/or after it emerges from the roll bodies of the pair of rolls 14, 16. The sensor arrangement in the exemplary embodiment of FIG. 1 has at least one force sensor 36, which is fitted to bearing lever 24 or to stand 22 and supplies its sensor signal to control unit 30. In principle, it is sufficient to provide only one such force sensor 36 along the transmission path 31 of the pressing force. In this case, it actually makes no difference whether force sensor 36 is fitted to bearing lever 24 or to stand 22, provided it is aligned and positioned in such a way that substantially only the force component to be registered passes through it, but completely through it. The choice of stand 22 as a fitting location for force sensor 36 can have the advantage that the cabling of force sensor 36 does not have to be led via a rotary point, although this does not represent a serious problem in the technology now available. Nevertheless, a preferable choice for the fitting location of force sensor 36 can result if material web 10 does not run into and out of application gap 12 rectilinearly, as in FIG. 1, but wraps partly around at least one of rolls 14, 16. Force sensor 36 is then preferably fitted to that one of the components: bearing lever 24 and stand 22 which carries the roll with the lesser wrap of material web 10. In this way, the influence of the web tension on the force management can be minimized.

Likewise, both bearing lever 24 and stand 22 can each be provided with at least one force sensor 36, which makes it possible to monitor the measured pressing force by comparing the sensor signals. Bearing lever 24 or stand 22 will expediently be provided with force sensor 36 axially on each side of the pair of rolls 14, 16, in order at least approximately to be able to obtain information about the axial distribution of the nip load.

Force sensor 36 can, for example, be constructed from strain gages which are fitted to the outside of bearing lever 24 or stand 22 and which detect the elastic deformation of bearing lever 24 or stand 22 which occur as a result of the mutual pressing of rolls 14, 16. Connecting a plurality of such strain gages together in bridge circuits is in principle known from the prior art.

Depending on the measured actual pressing force, control unit 30 effects suitable activation of force device arrangement 26 in order to obtain a desired pressing force, for example predefined by an operator by way of an entry on an operating desk, and to maintain it in the context of automatic regulation. The pressing force to be set will be equal in the axial end regions of the pair of rolls 14, 16 in most applications, so that the result is a line pressure which is constant over the machine width. In addition to determining the force, control unit 30 can also be designed to determine the oscillatory behavior of the pair of rolls 14, 16 from the sensor signals and to actuate force device arrangement 26 with the effect of influencing the oscillation.

The force made available by force device arrangements 26 can be transmitted substantially exclusively via rolls 14, 16 as the single force transmission path 31. However, the coating unit can be made stiffer overall and less susceptible to oscillations if the force made available by force device arrangement 26 is transmitted over a plurality of force transmission paths. For this purpose a pair of interacting stop elements 38, 40 is shown dashed in FIG. 1, of which one is arranged on bearing lever 24 and of which the other is arranged on stand 22. One of stop elements 38, 40, here the stop element 38, can be adjusted by way of a positioning element 42, which can be an actuating element, for example a reciprocating spindle element, that can be controlled by control unit 30. Accordingly, two force transmission paths are available to the force provided by force device arrangement 26: a first, which runs via rolls 14, 16, and a second, which runs via stop elements 38, 40. By adjusting the position of stop element 38, the ratio of the forces transmitted via the two force transmission parts, and therefore the effective pressing force between rolls 14, 16, can be varied.

The at least one force sensor 36 is located in the force transmission path running 31 via rolls 14, 16 at a point downstream of its branch from the second force transmission path and upstream of the renewed combination with the second force transmission path. In this way, the actual pressing force continues to be registered directly by force sensor 36, and any distortion or thermally induced deformations within the coating unit cannot distort the measured result.

During working operation of the coating unit, a maximum force is preferably always applied to bearing lever 24 by force device arrangement 26. Then, depending on the sensor signal supplied by force sensor 36, the desired pressing force is then set by way of suitable displacement of stop element 38. The further stop element 38 is displaced to the right in FIG. 1, the greater the proportion of the total available force transmitted via stop elements 38, 40 becomes. If the total force remains unchanged, the pressing force then decreases accordingly. The converse applies if stop element 38 is displaced to the left in FIG. 1.

In each case a pair of such stop elements 38, 40 is arranged on both axial sides of the pair of rolls 14, 16, it is possible for these pairs preferably to be adjustable independently by way of positioning element 42 in each case.

Figure 2:
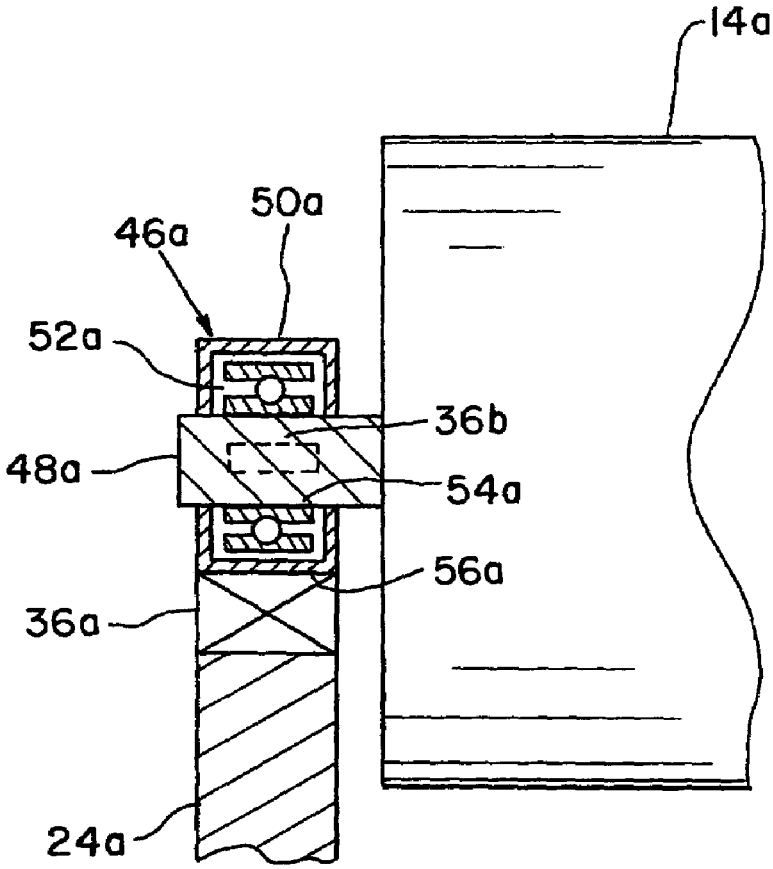
FIG. 2 is a schematic view of an embodiment of a bearing region of one of the rolls in order to explain variants of the sensor arrangement.

In FIG. 2, identical or identically acting components are provided with the same reference symbols as in FIG. 1, but supplemented by a lower-case letter. Since, in the following text, the intention is to discuss only differences from the previous exemplary embodiment, for the explanations relating to these components, reference should be made to the preceding description of FIG. 1.

FIG. 2 shows an exemplary embodiment in which one or more sensor elements not illustrated in detail, for example strain gages, are accommodated in force measuring cell 36*a*, which forms a mechanically sealed, separate component which is built in between bearing lever 24*a* and bearing kit 46*a*, which is used to mount axial bearing journal 48*a* of roll 14*a*. Bearing lever 24*a* and roll 14*a* are chosen only by way of example here. Such a force measuring cell can also be built in between the machine stand and the other roll. Bearing kit 46*a* has bearing housing 50*a* and antifriction bearing 52*a* accommodated therein with inner ring 54*a* and outer ring 56*a*. Force measuring cell 36*a* can, for example, be a commercially available force measuring block, such as is marketed by FMS Force Measuring Systems AG, Switzerland. The use of force measuring cell 36*a* has the advantage that the force looked for passes exactly through it and standardized standard components can be used for bearing housing 50*a* and for antifriction bearing 52*a*.

As an alternative to a force measuring cell, bearing journal 48*a* can also be extended to form a measuring pin by one or more suitable sensor elements being fitted to it. This is indicated by dashed lines at 36*b* in FIG. 2. Furthermore, it is possible to fix such sensor elements in bearing housing 50*a*. Bearing lever 24*a* can then remain constructively unchanged, and, for antifriction bearing 52*a*, recourse can again be made to a standard component.

As a further alternative measurement point for registering the pressing force, antifriction bearing 52*a* is suitable. Here, one or more sensor elements can be fitted subsequently, for example on outer ring 56*a*. The rolling elements of antifriction bearing 52*a* effect elastic deformations of outer ring 56*a* when loaded, which are a measure of the force transmitted and can be detected. Finally, it is conceivable to use antifriction bearing 52*a* with an integrated force sensor, that is to say a bearing which is already prepared with suitable force registering elements by the manufacturer. Without any constructional changes, the bearings of existing coating units can be replaced by such "measuring bearings".

As already mentioned above, the coating color with which material web 10 is intended to be coated is initially applied in a manner not specifically illustrated but known per se to rolls 14, 16 which, in turn, transfer the coating color to material web 10. Doctor units 32, 34 are used to meter and even out the coating color applied to rolls 14, 16. Doctor unit 32 has doctor bar 136, in which metering rod 138 is rotatably mounted. Doctor bar 136 is in turn fitted to pivoting arm 140 which is pivotably connected to bearing lever 24. By way of a further pivoting drive arrangement 142 supported between bearing lever 24 and pivoting arm 140, pivoting arm 140 can be moved toward moving roll 14 and in this way doctor bar 138 can be pressed against the surface of roll 14. In an analogous way, doctor unit 34 has doctor bar 144, metering rod 146 and pivoting arm 148 which is fitted pivotably to machine stand 22 and which, by way of pivoting drive arrangement 150 supported between machine stand 22 and pivoting arm 148, can be moved toward fixed roll 16. Pivoting drive arrangements 142, 150 are preferably in each case formed by a hydraulic piston-cylinder unit.

The amount and thickness of the color applied to material web 10 are influenced by the nip load prevailing in application gap 12, that is to say the pressing force which is transmitted between rolls 14, 16. When rolls 14, 16 are pressed against each other, their covers 128, 130 are compressed and flattened in the region of application gap 12, which is associated with a reduction in the distance between axes 18, 20 of rolls 14, 16. In the elastic range of this compression of the covers the mutual axial spacing, which is designated e in FIG. 1, is a measure of the pressing force transmitted and therefore the nip load in application gap 12. This behavior of pair of rolls 14, 16, corresponding to a spring, is used in the coating unit illustrated in order to set a specific desired nip load during coating operation. For this purpose, reference is made to a previously determined spring characteristic, which specifies the dependence of the axial spacing e on the pressing force transmitted, to see which axial spacing actually has to be set in order to obtain this desired pressing force. The spring characteristic is stored as data in electronic store 152, to whose stored content a microprocessor-aided control unit 30 makes access. The representation of the spring characteristic as data in store 152 can be one in the form of a formula. However, the spring characteristic will frequently be stored in a table in the form of a large number of value pairs, each of these value pairs containing for a value of the pressing force an associated value of the axial spacing e or a variable representative of the axial spacing.

In order to set the axial spacing e, use is made in the exemplary embodiment of positioning element 42 which is controlled by control unit 30 and which is preferably designed as a reciprocating spindle element driven by an electric motor. Positioning element 42 is used for the displacement of first stop 38 which is arranged to be stationary relative to machine stand 22 and which is intended to interact with a second stop element 40 arranged fixedly on bearing lever 24. During working operation of the coating unit, bearing lever 24 is pivoted in direction of the fixed roll 16 by way of force device arrangement 26 until the two stop elements 38, 40 strike each other. The axial spacing e of rolls 14, 16 in this operating position depends on the position of first stop element 38. The axial spacing e can thus be changed by displacing first stop element 38. During working operation of the coating unit, control unit 30 controls positioning element 42 in accordance with the information obtained from the spring characteristic such that the value of the axial spacing e which corresponds to a desired nip load is set. This desired nip load is communicated to control unit 30 by an operator, for example via an operating desk, not specifically illustrated.

The determination of the spring characteristic is carried out in a calibration phase preceding the actual working operation of the coating unit. In this case, for example, the procedure can be as follows: first of all, a zero point of the spring characteristic is determined. For this purpose, first stop element 38 is moved back to the left in FIG. 1 by way of positioning element 42. Then, by way of force device arrangement 26, bearing lever 24 is pivoted in the direction of fixed roll 16 until rolls 14, 16 substantially transmit no force, that is to say make contact without producing a nip load. This state can be determined, for example by an operator, by way of a paper strip, which is held in application gap 12. When rolls 14, 16 are stationary, the intended state is achieved when the paper strip can still just be pulled through application gap 12. When the rolls are rotating, the fact that the intended state has been reached can be detected by rolls 14, 16 beginning to tug at the paper strip. As soon as the intended state has been reached, first stop element 38 is moved forward again by way of positioning element 42 until it comes into contact with second stop element 40. The production of contact is detected by way of sensor 62 which, for example, can be a contact sensor, but also a force sensor. This position of first stop element 38 is stored by control unit 30. It represents a value of the axial spacing e at which substantially no pressing force is transmitted between rolls 14, 16, that is to say the zero point of the spring characteristic.

Following the determination of the characteristic zero point, at least one further characteristic point must be recorded at a defined nip load. This can be, for example, the end point of the spring characteristic at which a maximum nip load for which the coating unit is determined and designed is reached. In order to determine this further characteristic point, first stop element 38 is again moved back by way of positioning element 42 until it is out of the range of second stop element 40. Then, by activating force device arrangement 26, a force is introduced into bearing lever 24 such that roll 14 is pressed against roll 16, producing a nip load. By way of theoretical considerations taking account of the geometric relationships of the coating unit, the force made available by force device arrangement 26 can readily be used to calculate the line load prevailing in application nip 12, in any case as long as stop elements 38, 40 are out of contact and no force is transmitted between them. After a defined nip load has been produced by way of force device arrangement 26, first stop element 38 is then moved back toward second stop element 40 again by way of positioning element 42, until it comes into contact with stop element 60. The production of contact is again detected by sensor 62. The position assumed by first stop element 38 at the moment at which contact is produced is a different position than that when determining the zero point of the spring characteristic. Because of the mutual pressing of rolls 14, 16, roll covers 128, 130 are flattened somewhat, specifically in the region of application gap 12, as a result of which rolls 14, 16 have moved somewhat closer to each other as compared with the zero point of the spring characteristic. The axial spacing e of rolls 14, 16 is now somewhat smaller than at the characteristic zero point. This position of first stop element 38 is also stored by control unit 30, specifically in connection with the associated nip load.

Two characteristic points are now available, using which control unit 30 can, if necessary, interpolate the entire characteristic step by step. Of course, more than two characteristic points can be recorded in the calibration phase. In particular, nearly the entire spring characteristic can be recorded by measurement. Instead of the zero point and the end point of the spring characteristic, two other desired characteristic points located between them can be recorded and made the basis of a subsequent characteristic interpolation.

During working operation of the coating unit, a force is preferably always made available by force device arrangement 26 such that, when first stop element 38 is out of contact with second stop element 40 and, consequently, no force is transmitted via stop elements 38, 40, the nip load is a maximum and, consequently, the axial spacing e is a minimum. If a lower nip load is to be set, control unit 30 effects displacement of first stop element 38 in the direction of second stop element 40 by an appropriate amount on the basis of the characteristic data stored in store 152. As a result, the axial spacing e between rolls 14, 16 is enlarged, so that the flattening of roll covers 128, 130 in application gap 12 becomes lower and the nip load decreases accordingly. Since the force made available by force device arrangement 26 remains unchanged, the differential proportion between this force made available and the force transmitted via rolls 14, 16 is transmitted via the two stop elements 38, 40. The total force made available is therefore branched to a first force transmission path, which leads via rolls 14, 16, and a second force transmission path, which leads via stop elements 38, 40. The further first stop element 38 is moved forward to the right in the FIG. 1 the greater is the proportion of the overall force made available that is transmitted via stop elements 38, 40. The nip load in application gap 12 becomes correspondingly lower. A desired nip load can accordingly be obtained in a simple way by way of appropriate adjustment of first stop element 38.

Thermal influences, mechanical distortions and contact oscillations can lead to the axial spacing e changing during working operation of the coating unit. In order to detect such spacing fluctuations, distance sensor 64 can be provided, whose sensor signals are evaluated by control unit 30 and, if required, are converted into corresponding correction signals to positioning element 42. In this way, a control loop can be set up which keeps the axial spacing e constant at a desired value. Distance sensor 64 can be an optical sensor, for example. Of course, other sensor principles are also conceivable.

If sensor 62 permits registration of the force transmitted via stop elements 38, 40, a force control system can also be set up directly instead of a spacing control system. Since the force transmitted via stop elements 38, 40 permits conclusions to be drawn directly about the nip load in application gap 12, given knowledge of the total force made available by force device arrangement 26, the sensor signals from sensor 62 can also be used to regulate the position of first stop element 38.

The subassembly including positioning element 42 and stop elements 38, 40 is expediently provided on both axial sides of the pair of rolls 14, 16, each positioning element 42 preferably being independently controllable. In this way, the axial spacing e on both axial sides can be set independently of one another. This makes it possible to set a line load in application gap 12 which changes in the axial direction even if, in many applications, a constant line load will be desired. At the same time, this makes it possible for fluctuations in the axial spacing e which occur during operation and which possibly occur only locally on one axial side to be controlled out individually.

An alternative procedure for determining the spring characteristic will now been described. In this case, first of all only one axial side of the coating unit will be considered, even though the following process is, of course, carried out on both axial sides. This alternative procedure therefore begins in that, on the axial side of the coating unit being considered, first stop element 38 there is moved into a front, fully moved out end position by way of the associated positioning element 42. Then, roll 14 is pivoted toward roll 16 until second stop element 40 strikes first stop element 38. The front end position of first stop element 38 is in this case such that rolls 14, 16 do not touch each other when two stop elements 38, 40 are in mutual contact. Force device arrangement 26 is activated in such a way that the force exerted by it on bearing lever 24 is a maximum. In this case, maximum force is understood to describe that force which would result in the maximum nip load if the force were transmitted only via the pair of rolls of 14, 16. However, since, when first stop element 38 is moved out fully, the force transmission path leading via rolls 14, 16 is open, the force made available by force device arrangement 26 is transmitted only via stop elements 38, 40. Sensor 62 arranged in this force transmission path is designed as a force sensor in the alternative procedure described here. The force value which it detects when first stop element 38 is moved out fully and with the maximum force of force device arrangement 26 is stored by control unit 30.

Roll 14 is then moved back again and, by actuating positioning element 42, first stop element is moved into a rear, fully moved back end position. Roll 14 is then again pivoted toward roll 16 with the maximum force of force device arrangement 26. The rear end position of first stop element 38 is set such that second stop element 40 in this case does not strike first stop element 38. The maximum nip load therefore prevails in application gap 12. Then, by way of positioning element 42, first stop element 38 is moved forward until it comes into contact with second stop element 40. The production of contact between the two stop elements 38, 40 is determined from the signal from force sensor 62, for example when control unit 30 detects a change of a predetermined value in the measured force. The position of first stop element 38 reached in this way is stored; it represents the end point of the spring characteristic at which the maximum nip load prevails in application gap 12.

By actuating positioning element 42, first stop element 38 is then moved further out. In the process, the force transmitted via stop elements 38, 40 increases. When first stop element 38 has been moved out to such an extent that force sensor 62 indicates the force value stored at the beginning, positioning element 42 is stopped and the position of first stop element 38 is stored. It corresponds to the zero point of the spring characteristic. By way of linear interpolation, a plurality of intermediate characteristic points can be calculated from the zero and end points of the spring characteristic determined in this way.

The alternative procedure for determining the spring characteristic, described above, has the advantage that no different forces have to be set on force device arrangement 26, instead that it is sufficient merely to set the maximum force on force device arrangement 26 in order to determine both the characteristic zero point and the characteristic end point. In addition, the expenditure of time for the calibration of the coating unit is lower, since only reversal of the direction of movement of positioning element 42 is required.

External forces (for example the weights of various components of the coating unit, such as a color feed line) can lead to a skewed position of rolls 14, 16 relative to each other, for whose compensation it is necessary for force device arrangement 26 to exert different forces on bearing lever 24 on the two axial sides of the coating unit. In order to take such external influences into account even during the calibration, the alternative procedure described above for determining the characteristic curve can be modified in the following way. At the start of the calibration process, the two first stop elements 38 on both axial sides of the coating unit are moved into their front end position, and force device arrangement 26 is activated in such a way that it provides the same maximum force on both axial sides of the coating unit. Then, on each axial side, by way of respective force sensor 62, the force which is transmitted for each pair by first and second stop elements 38, 40 is measured. If first roll 14 is aligned exactly axially parallel with second roll 16, these force values are equal. If, on the other hand, there is a skewed position of first roll 14 relative to second roll 16, the result is different force values. The two force values determined in this way are stored by control unit 30. Then, as before, first stop elements 38 are moved into their rear end position and from this rear end position again as far as the production of contact with the respectively associated second stop element 40. Then, first stop element 38 on that axial side at which the greater force value was measured at the beginning is moved out in the direction of its front end position until, between the force values measured by force sensors 62, a difference is established which is equal to the difference between the force values measured at the beginning and stored. As soon as this state has been reached, the nonuniform mutual pressing of rolls 14, 16 which was caused by the original force difference is compensated for. The position of each of first stop elements 38 is then stored; it corresponds to the maximum nip load.

Then, both first stop elements 38 are moved together in the direction of their front end position until force sensors 62 indicate the force value originally stored for the respective axial side. Two positioning elements 42 are then stopped at the same time and their position and that of first stop elements 38 are defined as the zero nip load, that is to say as the characteristic zero point, and stored.

In the present example, it was assumed that force device arrangement 26 is force-controlled. If, however, a distance-controlled embodiment of force device arrangement 26 is chosen, for example by using a spindle drive, it is then possible to dispense with stop elements 38, 40 and positioning element 42 and instead for a desired axial spacing e to be set directly by way of force device arrangement 26. In this case, there would be only one force transmission path, which leads via rolls 14, 16. By contrast, the provision of at least one further force transmission path, as is formed by positioning element 42 and stop elements 38, 40 in the exemplary embodiment illustrated, has the advantage that the coating unit can be made stiffer overall and therefore less susceptible to oscillations.

In summary, the present invention permits very precise setting of a desired nip load, in particular even when this is comparatively low. As a result of the high precision of the nip load setting, irrespective of the roll diameter, of the roll cover thickness, of the roll hardness and any distortions, a higher-quality coating result can be achieved, the high precision of the nip load setting contributing to keeping contact oscillations between the rolls low. The possibility of setting even very low nip loads precisely as well helps, moreover, to reduce what is known as "misting", which refers to the coating color spraying in the manner of a mist at the outlet from the application gap and can have a detrimental effect on the coating result.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for pressing together a first roll and a second roll in a coating unit for a two-dimensional application of a liquid to pasty application medium to a moving fiber material web, the first roll having a first roll body, the second roll having a second roll body, the first roll being arranged axially parallel to the second roll, at least one of the first roll and the second roll being movable relative an other of the first roll and the second roll, comprising:

a force device arrangement for providing a force being transmitted at least partly in a force transmission path running from said force device arrangement to at least one of the first roll and the second roll, said force device arrangement producing a pressing force between the first roll and the second roll;

at least one sensor registering said pressing force between the first roll and the second roll, said at least one sensor being arranged in said force transmission path, said at least one sensor being arranged outside the first roll body and the second roll body; and a stand connected to the second roll and a bearing lever connected to the first roll, a position of the second roll being fixed relative said stand, the second roll being rotatable, the first roll being rotatable, said bearing lever connected to said stand, said bearing lever being pivotable relative said stand to bring the first roll and the second roll together, said force device arrangement acting on said bearing lever.

2. The device of claim 1, wherein said fiber material web is one of a paper web and a board web.

3. The device of claim 1, further including at least one second force transmission path, said force being transmitted at least partly in said force transmission path being branched to said force transmission path and said at least one second force transmission path, said at least one sensor being arranged in said force transmission path after said force transmission path branches away from said at least one second force transmission path.

4. The device of claim 3, wherein said force being transmitted at least partly in said force transmission path includes a first force associated with said force transmission path and a second force associated with said at least one second force transmission path, a ratio of said first force to said second force can be varied.

5. The device of claim 4, further including at least one stop element arranged in said at least one second force transmission path, said at least one stop element being adjusted to change said ratio of said first force to said second force.

6. The device of claim 1, further including a force transmission direction associated with said force transmission path, at least one said sensor being arranged upstream of the first roll body relative to said force transmission direction.

7. The device of claim 1, further including a force transmission direction associated with said force transmission path, at least one said sensor being arranged downstream of the second roll body relative to said force transmission direction.

8. The device of claim 1, further including a force transmission direction associated with said force transmission path, at least one said sensor being arranged upstream of the first roll body relative to said force transmission direction, at least one said sensor being arranged downstream of the second roll body relative to said force transmission direction.

9. The device of claim 1, wherein at least one said sensor is fitted to one of said bearing lever and said stand.

10. The device of claim 1, further including a bearing region associated with one of the first roll and the second roll, at least one said sensor being arranged in said bearing region.

11. The device of claim 10, further including a bearing journal associated with said bearing region, said at least one said sensor being arranged in said bearing region being fitted to said bearing journal.

12. The device of claim 10, further including an antifriction bearing enclosing a bearing journal associated with said bearing region, said antifriction bearing being provided with said at least one said sensor being arranged in said bearing region.

13. The device of claim 12, wherein said at least one said sensor being arranged in said bearing region is integrated into said antifriction bearing.

14. The device of claim 12, wherein said antifriction bearing includes an outer ring, said at least one said sensor being arranged in said bearing region is fitted onto said outer ring.

15. The device of claim 10, wherein said bearing region includes a bearing housing with an antifriction bearing surrounding a bearing journal, said at least one said sensor being arranged in said bearing region is fitted to said bearing housing.

16. The device of claim 1, further including a bearing kit for a bearing journal of one of the first roll and the second roll, a sensor module being built between said bearing kit and one of said stand and said bearing lever, at least one said sensor is accommodated in said sensor module.

17. The device of claim 1, wherein said at least one sensor includes at least one of a tension sensitive element and a pressure sensitive element.

18. The device of claim 17, wherein said at least one of a tension sensitive element and a pressure sensitive element includes a strain gage.

19. The device of claim 1, further including an electronic control unit responding to said at least one sensor, said electronic control unit controlling said force device arrangement, said electronic control unit being set up for a regulated maintenance of a predefined desired value of said pressing force.

20. The device of claim 1, wherein the moving material web is led between the first roll and the second roll, at least one of the first roll and the second roll is used to transfer the liquid to pasty application medium to the moving material web.

21. A device for pressing together a first roll and a second roll in a coating unit for a two-dimensional application of a liquid to pasty application medium to a moving fiber material web, the first roll having a first roll body, the second roll having a second roll body, the first roll being arranged axially parallel to the second roll, at least one of the first roll and the second roll being movable relative an other of the first roll and the second roll, comprising:

a force device arrangement for providing a force being transmitted at least partly in a force transmission path running from said force device arrangement to at least one of the first roll and the second roll, said force device arrangement producing a pressing force between the first roll and the second roll, wherein both the first roll and the second roll including a first axial end and a second axial end, said force device arrangement operational in both a region of said first axial end and a region of said second axial end, said force device arrangement operational in said region of said first axial end including a first independently controllable force device, said force device arrangement operational in said region of said second axial end including a second independently controllable force device;

at least one sensor registering said pressing force between the first roll end the second roll, said at least one sensor being arranged in said force transmission path, said at least one sensor being arranged outside the first roll body and the second roll body, said at least one sensor designed for a mutually independent registration of said pressing force in both said region of said first axial end and said region of said second axial end; and an electronic control unit responding to said at least one sensor, said electronic control unit controlling said force device arrangement, said electronic control unit being sat up for a regulated maintenance of a predefined desired value of said pressing force.

22. The device of claim 21, wherein at least one of said first independently controllable force device and said second independently controllable force device is a hydraulic device.

23. The device of claim 21, wherein said electronic control unit controls said first independently controllable force device and said second independently controllable force device such that a substantially constant line pressure results between the first roll and the second roll over an axial extent of the first roll and the second roll.

* * * * *

UNITED STATES PATENT AND TRADEMARK OFFICE

CERTIFICATE OF CORRECTION

PATENT NO. : 7,018,475 B2
APPLICATION NO. : 10/719201
DATED : March 28, 2006
INVENTOR(S) : Ueberschar et al.

It is certified that error appears in the above-identified patent and that said Letters Patent is hereby corrected as shown below:

COLUMN 18

At line 6, please delete “end”, and subsitute therefore --and--; and
At line 16, please delete “sat”, and substitute therefore --set--.

Signed and Sealed this

Nineteenth Day of December, 2006

JON W. DUDAS
*Director of the United States Patent and Trademark Office*